United States Patent [19]

Gorski

[11] Patent Number: 4,804,493

[45] Date of Patent: Feb. 14, 1989

[54] STABILIZED AZEOTROPE OR AZEOTROPE-LIKE COMPOSITION OF 1,1,2-TRICHLORO-1,2,2-TRIFLUOROETHANE AND TRANS-1,2-DICHLOROETHYLENE

[75] Inventor: Robert A. Gorski, Newark, Del.

[73] Assignee: E. I. Du Pont de Nemours and Company, Wilmington, Del.

[21] Appl. No.: 198,015

[22] Filed: May 24, 1988

[51] Int. Cl.[4] ..... C11D 7/30; C11D 7/50

[52] U.S. Cl. ..... 252/172; 252/171; 252/DIG. 9; 134/40

[58] Field of Search ..... 252/171, 172, 153, 162, 252/DIG. 9; 134/12, 38, 39, 40

[56] References Cited

U.S. PATENT DOCUMENTS 3,349,039 10/1967 Renault ..... 252/172

3,455,835 7/1969 Burt ..... 252/172

*Primary Examiner*—Paul Lieberman

*Assistant Examiner*—Kathleen Markowski

*Attorney, Agent, or Firm*—James E. Shipley

[57] ABSTRACT

A stabilized azeotrope or azeotrope-like composition is disclosed with 1,1,2-trichloro-1,2,2-trifluoroethane and trans-1,2-dichloroethylene containing effective stabilizing amounts of lower alkoxyphenol, 1,2-butylene oxide, nitromethane and/or 1,2-propylene oxide.

16 Claims, No Drawings

STABILIZED AZEOTROPE OR AZEOTROPE-LIKE COMPOSITION OF 1,1,2-TRICHLORO-1,2,2-TRIFLUOROETHANE AND TRANS-1,2-DICHLOROETHYLENE

BACKGROUND OF THE INVENTION

As modern electronic circuit boards become more and more complex with increased circuitry and component densities, thorough cleaning of boards after soldering becomes more and more important. In the manufacture of such printed electronic circuit boards, the components are usually fixed in place by soldering. Current industrial processes for soldering electronic components to circuit boards involve coating the entire circuit side of the board with fluxes which are commonly rosin acids used alone or with activating additives such as amine hydrochlorides or oxalic acid derivatives, and passing this coated side of the board over preheaters and then through molten solder. The flux cleans the conductive metal parts and promotes adhesion of the solder. The temperature used during soldering usually thermally degrades some of the flux leaving flux and flux residues on the board. These flux and flux residues may interfere with the electrical function of the circuit board and must be removed. The complexities of modern circuit boards are such that the only practical process for removing the remaining flux, flux residues and other foreign matters from the circuit board is by solvent cleaning.

The most commonly used current industrial process for cleaning circuit boards after soldering is by the use of vapor defluxing. In the conventional operation of a vapor defluxer, the soldered circuit board is passed through a sump of boiling organic solvent which removes the bulk of the residual flux (including thermally degraded flux) and thereafter through a sump containing freshly distilled solvent at near room temperature, and finally through solvent vapor over a boiling sump which provides a final rinse with clean solvent which condenses on the circuit board. In addition, the board can also be sprayed with distilled solvent before the final rinse.

Ideally, in the above vapor defluxing process, the solvent used would be a single pure solvent, but in practice it has not been possible to provide a single solvent with all the necessary characteristics of relatively low boiling point, nonflammability, low toxicity and high solvency for flux and flux residues. Therefore, in the art, it has been the practice to use a mixture of solvents to control these characteristics.

While solvent mixtures may be carefully tailored to control boiling, flammability and solvent power effectively, such a solvent mixture is not necessarily useful in industrially-used circuit board cleaning procedures such as vapor defluxing as described above. The major deterrent to the use of such solvent mixtures is that they fractionate to an undesirable degree during use. For example, in the vapor defluxing technique described above, the first stage in the cleaning consists of passing the soldered circuit board into a sump of boiling organic solvent. Under such conditions the lower boiling component of the solvent mixture may be vaporized leaving the higher boiling components of the mixture with altered solvency characteristics.

Again, in this cleaning procedure, the final rinse is carried out by passing the cleaned circuit board through solvent vapor over a boiling sump. This vapor condenses on the circuit board and any fractionation which may occur will alter its solvency characteristics. Finally, for the cleaning procedure to be economically feasible, the used solvent must be readily recoverable for reuse, usually by distillation. Again, the recovered solvent should have the same composition and characteristics as the original solvent system.

Thus, azeotropic solvent mixtures with their constant boiling and constant composition characteristics have been found to be very useful in the solvent cleaning process. Unfortunately, as recognized in the art, it is not possible to predict the formation of azeotropes and therefore there is constant effort to discover azeotropes or azeotrope-like solvent mixtures with desirable characteristics for cleaning circuit boards.

One such azeotropic composition is disclosed by Burt in U.S. Pat. No. 3,455,835 wherein a composition of from about 54 to about 64 percent by weight of 1,1,2-trichloro-1,2,2-trifluorethane and from about 36 to about 46 percent by weight of trans-1,2-dichloroethylene boils at about 44° C. at atmospheric pressure and is an effective cleaning solvent for circuit boards.

While the compositions as disclosed by Burt are effective solvent systems for cleaning circuit boards, the solvent systems should be stabilized against compositional and other changes during long term storage and prolonged use. Changes due to oxidation, polymerization, interaction of the components and the like may generate products which adversely affect the solvent composition itself and the performance of the circuit boards being cleaned.

It is, therefore, an object of the present invention to provide a stabilized azeotrope or azeotrope-like composition of 1,1,2-trichloro-1,2,2-trifluoroethane and trans-1,2-dichloroethylene. It is a further object of the present invention to provide a stabilized azeotropic composition of 1,1,2-trichloro-1,2,2-trifluoroethane and trans-1,2-dichloroethylene which minimizes corrosion of aluminum alloys and gel (polymer) formation.

SUMMARY OF THE INVENTION

According to the present invention, there is provided a stabilized azeotrope or azeotrope-like composition of 1,1,2-trichloro-1,2,2-trifluoroethane and trans-1,2-dichloroethylene containing effective stabilizing amounts of lower alkoxyphenol, 1,2-butylene oxide, nitromethane and/or 1,2-propylene oxide.

DETAILED DESCRIPTION OF THE INVENTION

The azeotropic solvent mixtures of the present invention are disclosed by Burt in U.S. Pat. No. 3,455,835. The azeotrope-like compositions comprise from about 54% to about 64% by weight of 1,1,2-trichloro-1,2,2-trifluoroethane and from about 36% to about 46% by weight of trans-1,2-dichloroethylene. A true azeotrope comprising about 59% by weight of 1,1,2-trichloro-1,2,2-trifluoroethane and about 41% by weight of trans-1,2-dichloroethylene boiling at about 44.1° C. at atmospheric pressure is also disclosed. The disclosures and the teachings of Burt in U.S. Pat. No. 3,455,835 are incorporated herein by reference.

While the azeotrope or azeotrope-like composition of 1,1,2-trichloro-1,2,2-trifluoroethane and trans-1,2-dichloroethylene have desirable attributes as a cleaning solvent for circuit boards, including outstanding performance in the vapor defluxing process, it is recognized that in order to take advantage of the unique properties of this solvent composition on a long-term commercial basis, certain other desirable properties should be imparted to the solvent composition.

One such desirable property is storage stability. It is recognized that any material which is to be used commercially must be inventoried. Such storage can be for a short term or longer periods of months or even years. Thus, for a solvent composition to be useful, it should be stabilized against any significant deleterious changes which may be brought about by oxidation, polymerization or interaction of components. Such changes may result in discoloration of the solvent, formation of undesirable by-products, such as acids, and/or formation of insoluble polymeric materials. It has been found that the addition of effective stabilizing amounts of a lower alkoxyphenol from about 0.001 to about 1 weight percent and effective stabilizing amounts of 1,2-butylene oxide of from about 0.01 to about 1 weight percent to the present azeotrope of azeotrope-like composition effectively stabilize the solvent composition.

By effective stabilizing amounts of the stabilizer components of the instant invention is meant amounts of each component which when combined with the azeotrope or azeotrope-like composition allows the azeotrope or azeotrope-like composition to be stored and used commercially.

Lower alkoxyphenol means methoxyphenol, ethoxyphenol and propoxyphenol; the preferred alkoxyphenol is methoxyphenol and the more preferred is 4-methoxyphenol. Higher concentrations of alkoxyphenol and 1,2-butylene oxide may be used but higher concentrations generally do not offer additional advantages under normal conditions.

Another desirable characteristic to be imparted to the solvent system of the instant invention is stability during use, including inertness towards materials of construction of both the circuit boards and the solvent cleaning equipment. As described above, in the vapor defluxing cleaning procedure, the circuit board to be cleaned is first passed through a sump containing boiling slvent for the removal of the bulk of the flux. In this sump, the organic solvent must be continuously boiled and, therefore, is in contact with a heating source for a prolonged time. After passage through the first sump, the circuit board is passed through a sump containing freshly distilled solvent, and finally through solvent vapor over the boiling solvent which vapor condenses to provide a final rinse of the circuit board.

Thus, during use, the organic solvent is subjected to constant heating either in maintaining boiling solvent or in vaporizing the solvent to provide solvent vapor for the final rinse. Generally, this heating of the solvent is carried out under ambient atmospheric conditions, i.e., in the presence of oxygen and moisture. Under these conditions, the solvent may undergo changes due to oxidation, polymerization or interaction among the components of the solvent system. It is therefore, highly desirable to minimize any change in the solvent system which can adversely affect the cleaning process or degrade the integrity of the solvent.

It has been found that in the azeotropic solvent system of 1,1,2-trichloro-1,2,2-trifluoroethane and trans-1,2-dichloroethylene, a combination of lower alkoxyphenol and 1,2-butylene oxide with an effective stabilizing amount of at least one of nitromethane and 1,2-propylene oxide provide both storage and in-use stability. As demonstrated in the Examples, both nitromethane and 1,2-propylene oxide independently exhibit stabilizing effectiveness, but the combination of the two apear to act synergistically in stabilizing the present systems, and such combination is thus preferred.

When nitromethane is used without 1,2-propylene oxide in combination with a lower alkoxyphenol and 1,2-butylene oxide, it should be present in effective stabilizing amounts of from about 0.1 to about 3 weight percent of the solvent system. Higher concentrations may be used but generally no additional advantages are obtained under normal conditions.

When 1,2-propylene oxide is used without nitromethane in combination with lower alkoxyphenol and 1,2-butylene oxide, it should be present in effective stabilizing amounts of from about 0.10 to about 1 weight percent of the solvent system. Higher concentrations may be used but generally no additional advantages are obtained under normal conditions.

However, when a combination of nitromethane and 1,2-propylene oxide is used along with a lower alkoxyphenol and 1,2-butylene oxide, the concentrations of nitromethane can be from about 0.025 weight percent to about 1 weight percent and the concentration of 1,2-propylene oxide can be from about 0.01 weight percent to about 1 weight percent. The combination containing both nitromethane and 1,2-propylene oxide is preferred and the preferred weight ratio of nitromethane to 1,2-propylene oxide is about 2:1.

The stabilized azeotrope or azeotrope-like composition of the present invention may contain from about 54 to about 64 percent by weight of 1,1,2-trichloro-1,2,2-trifluoroethane and from about 36 to about 46 percent by weight of trans-1,2-dichloroethylene and based on the weight of the azeotrope or azeotrope-like composition, about 0.001 to about 0.01 weight percent of a lower alkoxyphenol, about 0.01 to about 1 weight percent of 1,2-butylene oxide and at least one of nitromethane at about 0.1 to 1.0 weight percent and 1,2-propylene oxide at about 0.1 to 1.0 weight percent. Preferably, the stabilized composition will contain both nitromethane at about 0.025 to about 1.0 weight percent and 1,2-propylene oxide at about 0.01 to about 1.0 weight percent and the lower alkoxyphenol will be 4-methoxyphenol. More preferably, the stabilized composition will contain both nitromethane at about 0.2 weight percent and 1,2-propylene oxide at about 0.1 weight percent and the lower alkoxyphenol will be 4-methoxyphenol.

The present invention thus provides stabilized azeotropes or azeotrope-like compositions of 1,1,2-trichloro-1,2,2-trifluoroethane and trans-1,2-dichloroethylene which can be stored for long periods of time and which undergo little or no change during commercial use.

The lower alkoxyphenols, 1,2-butylene oxide, nitromethane, 1,2-propylene oxide, 1,1,2-trichloro-1,2,2-trifluoroethane and trans-1,2-dichloroethylene are all available commercially and the methods for their preparation are well known in the art. Commercial trans-1,2-dichloroethylene may contain minor amounts of its cis isomer, e.g., up to about 5%, the presence of which is considered to be innocuous.

The composition of the instant invention can be prepared by any convenient method including weighing a desired quantity of each component and thereafter mixing in any known manner.

EXAMPLES

Seven-day stability tests of a solvent combination of 63.5 weight percent 1,1,2-trichloro-1,2,2-trifluoroethane and 36.5 weight percent trans-1,2-dichloroethylene were carried out by refluxing 150 ml. of the solvent combination in 500 ml. "Pyrex" flasks using 90% water-saturated solvent (room temperature), with the indicated stabilizers. The flasks were connected to water-cooled condensers which in turn were connected to tubes containing "Drierite" desiccant to keep ambient air moisture from entering the flasks. Stainless steel (SS-304) specimens were located at the solvent vapor-/air interfaces in the condensers and coupled stainless steel SS-304/aluminum alloy Al-7075 specimens were located in the boiling liquids.

After the conclusion of the tests, the following determinations were made:

1. The increase in the chloride concentration ($Cl^-$) in the solvent. The solvent was extracted with an equal volume of distilled water and analyzed for chloride concentration both before and after the test. The corrosion products on the metal specimens were carefully removed by sliding a knife over the surface without removing base metal. These scrapings were added into each appropriate emptied flask which had been used in that particular test. Then 100 ml. of 5% sulfuric acid was added to each flask to scrub the flask walls and to dissolve the corrosion products. This solution was analyzed for chlorine ion concentration. The chloride ion concentration of the solvent plus the chloride ion concentration of the acid solution minus any chloride ion concentrations in the original solvent and acid solution was calculated as the increase in the chloride ion concentration which occurred during the test. This calculated chloride ion concentration represents additional chlorine which comes from degradation of the solvent components during the test.

2. The corrosion rates were determined by rubbing the surfaces of the metal speciments with ink and pencil erasers, brushing the surfaces, rinsing sequentially in 1,1,2-trichloro-1,2,2-trifluoroethane, distilled water and acetone and, thereafter, drying for a minimum of 24 hours over "Drierite" desiccant, and then weighing the metal specimens to ±0.0001 g. The loss in weight of the metal specimen is expressed in terms of mils/year. From the tests, the corrosion rate of aluminum Al-7075 of 4 mils per year or less was considered to be acceptable.

3. Additionally, the appearances of the solvent and the aluminum alloy specimens were rated visually using the following criteria:

| | | Appearance | |
|---|---|---|---|
| Rating | Acceptable | Liquid | Al-7075 |
| 0 | Yes | Clear, colorless No gel formation | Bright, shiny |
| 1 | Yes | Very, very slight gel formation | Very, very slight deposit |
| 2 | Borderline | Very slight gel formation | Very slight deposit/pitting |
| 3 | No | Slight gel formation | Slight deposit |
| 4 | No | Moderate gel formation | Moderate deposit |
| 5 | No | Severe gel formation | Severe deposit |

The examples are summarized in Table I. The following is the key to the abbreviations used to indicate the various inhibitors used in the examples.

1,2-BO—1,2 butylene oxide
NM nitromethane
1,2-PO—1,2 propylene
4-MP—4-methoxyphenol

TABLE I

SEVEN-DAY REFLUX TEST
1,1,2-TRICHLORO-1,2,2-TRIFLUOROETHANE (63.5%)/
TRANS-1,2-DICHLOROETHYLENE (36.5%)

| Ex. | Inhibitor | Wt. % | $Cl^-$ (ppm) | Al-7075 Corrosion (mils/yr) | Visual Rating Liquid | Visual Rating Al-7075 |
|---|---|---|---|---|---|---|
| 1 | None | — | 17 | 2 | 0 | 2 |
| 1a | None | — | 26 | 1 | 2 | 2 |
| 2 | 4-MP | 0.0036 | 1 | 0.5 | 1 | 1 |
| 3 | 1,2-BO | 0.0365 | 1 | 0.8 | 1 | 1 |
| 4 | 4-MP | 0.0036 | 2 | 0.6 | 1 | 1 |
| | 1,2-BO | 0.0365 | | | | |
| 5 | 4-MP | 0.0036 | 2 | 0.9 | 2 | 0 |
| | 1,2-BO | 0.0365 | | | | |
| | NM | 0.2 | | | | |
| 6 | 4-MP | 0.0036 | 0.2 | 2 | 0 | 0 |
| | 1,2-BO | 0.0365 | | | | |
| | NM | 0.8 | | | | |
| 7 | 4-MP | 0.0036 | 4 | 0.9 | 0 | 0 |
| | 1,2-BO | 0.0365 | | | | |
| | NM | 2.0 | | | | |
| 8 | 4-MP | 0.0036 | 4 | 0.6 | 0 | 0 |
| | 1,2-BO | 0.0365 | | | | |
| | NM | 3.0 | | | | |
| 9 | 4-MP | 0.0036 | 1 | 1 | 1 | 0 |
| | 1,2-BO | 0.0365 | | | | |
| | 1,2-PO | 0.20 | | | | |
| 10 | 4-MP | 0.0036 | 3 | 1 | 0 | 0 |
| | 1,2-BO | 0.0365 | | | | |
| | NM | 0.05 | | | | |
| | 1,2-BO | 0.025 | | | | |
| 11 | 4-MP | 0.0036 | 1 | 0.2 | 0 | 0 |
| | 1,2-BO | 0.0365 | | | | |
| | NM | 0.20 | | | | |
| | 1,2-PO | 0.10 | | | | |
| 12 | 4-MP | 0.0036 | 4 | 0.9 | 1 | 0 |
| | 1,2-BO | 0.0365 | | | | |
| | NM | 0.80 | | | | |
| | 1,2-PO | 0.40 | | | | |

I claim:

1. A stabilized azeotrope composition comprising from about 54 to about 64 percent by weight of 1,1,2-trichloro-1,2,2-trifluoroethane and from about 36 to about 46 percent by weight of trans-1,2-dichloroethylene and effective stabilizing amounts of a lower alkoxyphenol, 1,2-butylene oxide and at least one of nitromethane and 1,2-propylene oxide.

2. The composition of claim 1 wherein said alioxyphenol is present in concentration from about 0.001 to about 1 weight percent, said 1,2-butylene oxide is present in concentration from about 0.01 to about 1 weight percent, said nitromethane is present in concentration from about 0.025 to about 3 weight percent and said 1,2-propylene oxide is present in concentration from about 0.01 to about 1 weight percent.

3. The composition of claim 2 wherein said alkoxyphenol is 4-methoxyphenol.

4. The composition of claim 1 wherein both nitromethane and 1,2-propylene oxide are present.

5. The composition of claim 4 wherein said nitromethane is present in concentration from about 0.025 to about 1 weight percent and said 1,2-propylene oxide is present in concentration from about 0.01 to about 1 weight percent.

6. The composition of claim 5 wherein the weight ratio of nitromethane to 1,2-propylene oxide is about 2:1.

7. The composition of claim 1 wherein said nitromethane is present in concentration from about 0.1 to about 3 weight percent.

8. The composition of claim 1 wherein said 1,2-propylene oxide in concentration from about 0.1 to about 1 weight percent.

9. The composition of claim 1 wherein the amount of said 1,1,2-trichloro-1,2,2-trifluoroethane is about 59 percent by weight and the amount of said trans-1,2-dichloroethylene is about 41 percent by weight.

10. The composition of claim 9 wherein said alkoxyphenol is present in concentration from about 0.001 to about 1 weight percent, said 1,2-butylene oxide is present in concentration from about 0.01 to about 1 weight percent, said nitromethane is present in concentration from about 0.025 to about 3 weight percent and said 1,2-propylene oxide is present in concentration from about 0.01 to about 1 weight percent.

11. The composition of claim 9 wherein said alkoxyphenol is 4-methoxyphenol.

12. The composition of claim 9 wherein both nitromethane and 1,2-propylene oxide are present.

13. The composition of claim 12 wherein said nitromethane is present in concentration from about 0.01 to about 1 weight percent and said 1,2-propylene oxide is present in concentration from about 0.01 to about 1 weight percent.

14. The composition of claim 13 wherein the weight ratio of nitromethane to 1,2-propylene oxide is about 2:1.

15. The composition of claim 9 wherein said nitromethane is present in concentration from about 0.1 to about 3 weight percent.

16. The composition of claim 9 wherein said 1,2-propylene oxide in concentration from about 0.1 to about 1 weight percent.

* * * * *